US010890009B2

(12) United States Patent
Young et al.

(10) Patent No.: US 10,890,009 B2
(45) **Date of Patent: *Jan. 12, 2021**

(54) MODULAR CRYPT AND MODULAR CRYPT SYSTEM WITH NICHE SIDE WALL

(71) Applicant: MATTHEWS INTERNATIONAL CORPORATION, Pittsburgh, PA (US)

(72) Inventors: Charles T. Young, Leetsdale, PA (US); Kenneth B. Bridgeman, Hidden Valley, PA (US)

(73) Assignee: Matthews International Corporation, Pittsburgh, PA (US)

( * ) Notice: Subject to any disclaimer, the term of this patent is extended or adjusted under 35 U.S.C. 154(b) by 517 days.

This patent is subject to a terminal disclaimer.

(21) Appl. No.: 15/284,117

(22) Filed: Oct. 3, 2016

(65) Prior Publication Data

US 2017/0089091 A1 Mar. 30, 2017

Related U.S. Application Data

(63) Continuation of application No. 14/798,684, filed on Jul. 14, 2015, now Pat. No. 9,458,643, which is a (Continued)

(51) Int. Cl.
*E04H 13/00* (2006.01)

(52) U.S. Cl.
CPC ..... *E04H 13/006* (2013.01)

(58) Field of Classification Search
CPC ..... E04H 13/00; E04H 13/006; E04H 13/008
(Continued)

(56) References Cited

U.S. PATENT DOCUMENTS 1,406,192 A 2/1922 Kennedy
1,453,375 A 5/1923 Allen
(Continued)

FOREIGN PATENT DOCUMENTS

CA 2702682 A1 10/2010
CA 2762740 A1 7/2012
(Continued)

OTHER PUBLICATIONS

Osisio Antica Fonderia D'Arte Catalogo Cimiteri 2008, Catalog.
(Continued)

*Primary Examiner* — Ryan D Kwiecinski
(74) *Attorney, Agent, or Firm* — Troutman Pepper Hamilton Sanders LLP

(57) ABSTRACT

A modular crypt structure comprising a frame, a module insert defining a chamber and a closure panel and methods of constructing the same are disclosed. The chamber functions as a crypt module and receives bodily remains or portions thereof. The chamber is closed by attaching a closure panel, such as a stone crypt front to the frame. The modular crypt frame may comprise a plurality of horizontal bars and a plurality of vertical bars. A method of constructing a modular crypt structure comprises erecting a frame, providing at least one module insert, configuring the insert to define a chamber adapted to receive bodily remains, and closing the crypt module. A modular crypt system including a niche side wall is also disclosed having a niche side wall frame, a niche insert defining a plurality of niches positioned within the frame, and a closure panel positioned on the niche side wall frame.

37 Claims, 16 Drawing Sheets

Related U.S. Application Data continuation of application No. 13/987,407, filed on Jan. 10, 2011, now Pat. No. 9,080,344, which is a continuation-in-part of application No. 12/762,645, filed on Apr. 19, 2010, now Pat. No. 9,249,598.

(60) Provisional application No. 61/174,058, filed on Apr. 30, 2009.

(58) Field of Classification Search
USPC ..... 52/124.1, 128, 133, 136, 137, 139, 142; 27/1
See application file for complete search history.

(56) References Cited

U.S. PATENT DOCUMENTS

| | | | | |
|---|---|---|---|---|
| 2,513,951 | A | 7/1950 | McClellen | |
| 3,183,574 | A | 5/1965 | Diem | |
| 3,254,773 | A | 6/1966 | Diem | |
| 3,529,730 | A | 9/1970 | Thompson | |
| 3,754,805 | A | 8/1973 | Pangburn et al. | |
| 3,897,663 | A | 8/1975 | Gaul | |
| 4,048,772 | A | 9/1977 | Gaul | |
| 4,073,100 | A | 2/1978 | DiGiovanni, Jr. | |
| 4,433,883 | A | 2/1984 | Boender et al. | |
| 4,523,413 | A | 6/1985 | Koppenberg | |
| 4,648,219 | A | 3/1987 | Johnston, Sr. | |
| 4,669,157 | A | 6/1987 | Schwarten | |
| 4,862,655 | A | 9/1989 | LePage et al. | |
| 4,928,447 | A | 5/1990 | Stoecklein | |
| 5,115,607 | A | 5/1992 | Pirozzoli et al. | |
| 5,243,794 | A | 9/1993 | Pikor | |
| 5,408,787 | A | 4/1995 | Barnett | |
| 5,419,091 | A * | 5/1995 | Roberts | E04H 13/006 52/134 |
| 5,894,699 | A | 4/1999 | Fulton et al. | |
| 5,899,045 | A | 5/1999 | Giannarelli | |
| 6,105,315 | A * | 8/2000 | Stoecklein | E04H 13/006 27/1 |
| 6,250,025 | B1 * | 6/2001 | Darby | E04H 13/006 52/137 |
| 6,578,323 | B1 * | 6/2003 | Zartman | E04H 13/006 27/1 |
| 6,681,534 | B2 | 1/2004 | David et al. | |
| 6,799,399 | B2 | 10/2004 | Dudek et al. | |
| 7,415,800 | B2 | 8/2008 | Stienwand | |
| 7,591,053 | B2 | 9/2009 | Bosisio et al. | |
| 7,926,228 | B1 | 4/2011 | Snow | |
| 9,080,344 | B2 | 7/2015 | Young et al. | |
| 9,249,598 | B2 | 2/2016 | Bridgeman et al. | |
| 9,458,643 | B2 | 10/2016 | Young et al. | |
| 2009/0229197 | A1 | 9/2009 | Bach Lahor | |
| 2010/0162639 | A1 | 7/2010 | Adair et al. | |
| 2010/0275529 | A1 | 11/2010 | Bridgeman et al. | |
| 2011/0154748 | A1 | 6/2011 | Young et al. | |
| 2016/0138292 | A1 | 5/2016 | Young et al. | |
| 2016/0251871 | A1 | 9/2016 | Bridgeman et al. | |

FOREIGN PATENT DOCUMENTS

| | | | |
|---|---|---|---|
| MX | 2010-004649 | A | 11/2010 |
| MX | 2012-000479 | A | 7/2012 |

OTHER PUBLICATIONS

Agganciare/Ripiani Ai 4 Pilastri Gia Posizionait, Partendo Dal Basso, Ferrarini System, at least as early as 2009.

Strutture Prefabbricate: Schedario Dei Collegamenti, May 2007.

* cited by examiner

MODULAR CRYPT AND MODULAR CRYPT SYSTEM WITH NICHE SIDE WALL

CROSS REFERENCE TO RELATED APPLICATIONS

This application is a continuation of U.S. patent application Ser. No. 14/798,684, filed Jul. 14, 2015, which is a continuation of U.S. patent application Ser. No. 12/987,407, filed Jan. 10, 2011, now U.S. Pat. No. 9,080,344, issued Jul. 14, 2015, which is a Continuation-in-Part of U.S. patent application Ser. No. 12/762,645, filed Apr. 19, 2010, which claims the benefit of U.S. Provisional Application No. 61/174,058, filed Apr. 30, 2009, which are hereby incorporated by reference in their entirety.

BACKGROUND OF THE INVENTION

Field of the Invention

This invention relates to an indoor or outdoor modular crypt structure and, in particular, to a crypt structure which minimizes the need to pour concrete to construct the crypt structure.

Description of Related Art

Crypt structures, or alternatively mausoleums, are structures that comprise a plurality of chambers for the entombment of bodily remains and/or corpses. Normally, crypt structures are above-ground structures which are freestanding or located within an existing building. The exteriors of these structures are oftentimes covered with granite, marble or other various finish materials to make them aesthetically pleasing.

Crypt structures are generally constructed in situ by pouring concrete into erected forms, usually constructed of wood, to form the walls and chambers of the crypt structure. This process is expensive and time consuming. The forms are removed after the concrete has cured. Oftentimes, concrete can contain excessive voids which can compromise structural integrity. Thus, skilled laborers must usually be employed to ensure proper formation of the crypt structure. Some circumstances require that the concrete crypts are precast off-site. This would require the additional expenses associated with transporting and installing concrete structures of great weight. Special installation equipment, such as large trucks, cranes, or the like may also be required to properly install such constructions.

Some examples of modular crypt structures can be found in U.S. Pat. No. 4,048,772 to Gaul; U.S. Pat. No. 5,243,794 to Pikor; and U.S. Pat. No. 6,105,315 to Stoecklein et al. The assemblies disclosed in these patents require almost complete fabrication of the crypt chambers and chamber walls prior to erecting the resulting crypt structure at the installation site, thereby still necessitating significant expense.

Therefore, a need exists to provide a modular crypt structure which overcomes the above-described deficiencies.

SUMMARY OF THE INVENTION

One embodiment of the present invention is directed to a modular crypt structure comprising a first frame, at least one module insert comprising a plurality of walls defining a chamber having at least one open end, and a closure panel. The insert is positioned within the first frame and the chamber adapted to receive bodily remains, which may be contained within a casket. The closure panel is attached to the first frame at an end adjacent to the at least one open end of the insert. The module insert may include both one open end and one closed end. The first frame may comprise a plurality of horizontal bars vertically aligned with one another, a plurality of vertical bars horizontally aligned with one another, and a plurality of support beams. The horizontal bars may intersect the vertical bars and the support beams may intersect the horizontal bars in a horizontal plane, thereby forming a platform. The module insert may then be positioned on the resulting platform. The crypt module may also comprise a crypt sealing cap, which is attached to the module insert at an end adjacent to the at least one end of the chamber. Additionally, the modular crypt structure may comprise a plurality of module inserts. The module inserts may each comprise a plurality of walls defining a plurality of chambers having at least one open end, wherein the inserts are situated within the first frame, and the chambers function as crypt modules for the insertion of bodily remains. The modular crypt structure may also comprise a trim plate which is attached to a bottom portion of the frame.

In other embodiments, the frame may comprise a metal, such as aluminum, the module insert may comprise a plastic, fiberglass, polymer material, or a metal, and the closure panel may comprise marble or granite.

In one embodiment of the present invention, the modular crypt structure comprises an anchor assembly for attaching the closure panel to the frame. The anchor assembly may secure the periphery of the closure panel to the frame. The anchor assembly may comprise an anchor assembly body, a spring-loaded flange, an extension attached to the anchor assembly body and defining a hole therein, at least one bolt, a rosette defining a hole therein, and a screw. The bolt secures the anchor assembly body to the frame, and the screw extends through the rosette hole and the extension hole, such that the screw secures the rosette to the extension. The closure panel rests on a top surface of the extension, and the spring-loaded flange biases the rear surface of the closure panel such that the front surface of the closure panel is biased against the rosette. The anchor assembly may also comprise bronze and/or stainless steel.

Yet another embodiment is directed to a modular crypt structure which comprises a second frame. The second frame may be positioned such that a back end of the second frame is adjacent to a back end of the first frame. The first frame and second frame may also be integrally formed. In these embodiments, the module insert may comprise a second open end and extend through the first and second frames. Alternatively, this embodiment may comprise at least two inserts, each comprising a plurality of walls defining chambers having at least one open end. A first insert is positioned within the first frame with the at least one open end located at an end of the first frame opposite the back end of the first frame. A second insert is positioned within the second frame with the at least one open end located at an end of the second frame opposite the back end of the second frame. The chambers are adapted to receive bodily remains or portions thereof. A second closure panel may be attached to the second frame at an end opposite the back end of the second frame.

Further, the present invention is directed to an embodiment comprising a roof and at least two walls. A first wall may be positioned parallel to a first side of the first frame, and a second wall may be positioned parallel to the second side of the first frame. The roof may be positioned above the frame and supported by the first and second walls such that the first frame is surrounded by the roof and walls. The modular crypt structure may also comprise a plurality of wall support bars. The wall support bars may be positioned on the first and second sides of the frame, such that they bias an inside surface of the first and second wall. Alternatively, when the frame comprises a plurality of vertical bars, the roof may extend across the width and length of the frame being supported by and secured directly to the vertical bars.

One embodiment of a modular crypt system may include a crypt frame having a first side and a second side; at least one module insert, the insert comprising a plurality of walls defining a chamber having at least one open end, wherein the insert is positioned within the crypt frame and the chamber is adapted to receive bodily remains or portions thereof; a closure panel, the closure panel being attached to the crypt frame at an end of the crypt frame adjacent to the at least one open end of said chamber; and a first niche side wall positioned parallel to at least one of the first side and the second side of the crypt frame. The first niche side wall includes a side wall frame attached to at least one of the first side and second side of the crypt frame; a niche insert; and a niche closure panel. The niche insert has a closed end and an open end, and is positioned in the side wall frame such that the closed end faces toward the crypt frame and the open end faces away from the crypt frame. The niche insert defines a plurality of niches accessible from the opened end of the niche insert and adapted to receive bodily remains. The niche closure panel is attached to the side wall frame adjacent the open end of the niche insert closing the plurality of niches. The niche insert may also include a plurality of internal niche walls defining the plurality of niches. The internal niche walls may be intersecting vertical and horizontal walls. The niche side wall frame may include a plurality of horizontal bars vertically aligned with one another and a plurality of vertical bars horizontally aligned with one another, with the horizontal bars intersecting the vertical bars. The niche insert may include a flanged edge positioned around the periphery of the open end of the niche insert. The flange edge may engage the front surface of the horizontal and vertical bars. The modular crypt system may also include a plurality of niche inserts and/or a plurality of niche closure panels.

Additionally, a second niche side wall may be provided such that a niche side wall is provided on each of the first and second sides of the crypt frame. The second niche side wall includes a second side wall frame attached to a side of the crypt frame; a second niche insert; and a second niche closure panel. The second niche insert has a closed end and an open end and is positioned in the side wall frame such that the closed end faces toward the crypt frame and the open end faces away from the crypt frame. The second niche insert defines a plurality of niches accessible from the open end of the niche insert and adapted to receive bodily remains. The second niche closure panel is attached to the side wall frame adjacent the open end of the niche insert closing the plurality of niches.

An embodiment of a modular crypt system may also include a roof positioned above the crypt frame and supported by the first niche side wall and/or the second niche side wall. The roof may also be supported by and secured to vertical bars of the crypt frame, the first side wall frame, and the second side wall frame.

Lastly, other embodiments of the present invention are directed to methods for constructing a modular crypt and for encapsulating bodily remains. These methods may comprise the steps of erecting a frame; providing at least one module insert; configuring the insert to define a chamber having at least one open end adapted to receive bodily remains or portions thereof; positioning the module insert in the frame; and closing the crypt module at an end associated with the at least one open end of the module insert. The methods may also comprise attaching a closure panel to the frame at an end of the frame associated with the at least one open end of the chamber. Further, walls and a roof may be provided around the frame. The method for encapsulating bodily remains may further comprise inserting bodily remains or portions thereof into the crypt module before closing the crypt module and providing a sealing cap in the chamber near the open end of the chamber. Both methods may comprise providing a plurality of vertical bars, horizontal bars and support beams; aligning the vertical bars horizontally and the horizontal bars vertically in an intersecting manner; forming a platform by arranging the support beams in a horizontal plane with the horizontal bars such that they intersect the horizontal bars; and positioning the module insert on the platform.

DESCRIPTION OF THE PREFERRED EMBODIMENTS

In the following Description of the Preferred Embodiments, "crypt module" is a chamber, vault, or another space defined within a crypt structure or mausoleum for encapsulating and/or entombing bodily remains.

"Module insert" is a piece of material which defines a crypt module within a frame according to the present invention. The module insert may be a flexible or a rigid material. It may comprise plastic, a polymer, fiberglass, or any material sufficient to encapsulate and/or entomb bodily remains.

"Bodily remains" refers to deceased persons and/or animals, human and/or animal corpse or corpses, portions of corpses and/or deceased persons, cremated remains, or any combination thereof, either enclosed in a casket and/or coffin or not.

For purposes of the description hereinafter, spatial orientation terms, if used, shall relate to the referenced embodiment as it is oriented in the accompanying drawing Figs. or otherwise described in the following detailed description. However, it is to be understood that the embodiments described hereinafter may assume many alternative variations and embodiments and that the specific embodiments illustrated in the accompanying drawing Figs. and described herein are simply exemplary and should not be considered as limiting.

Figure 1:
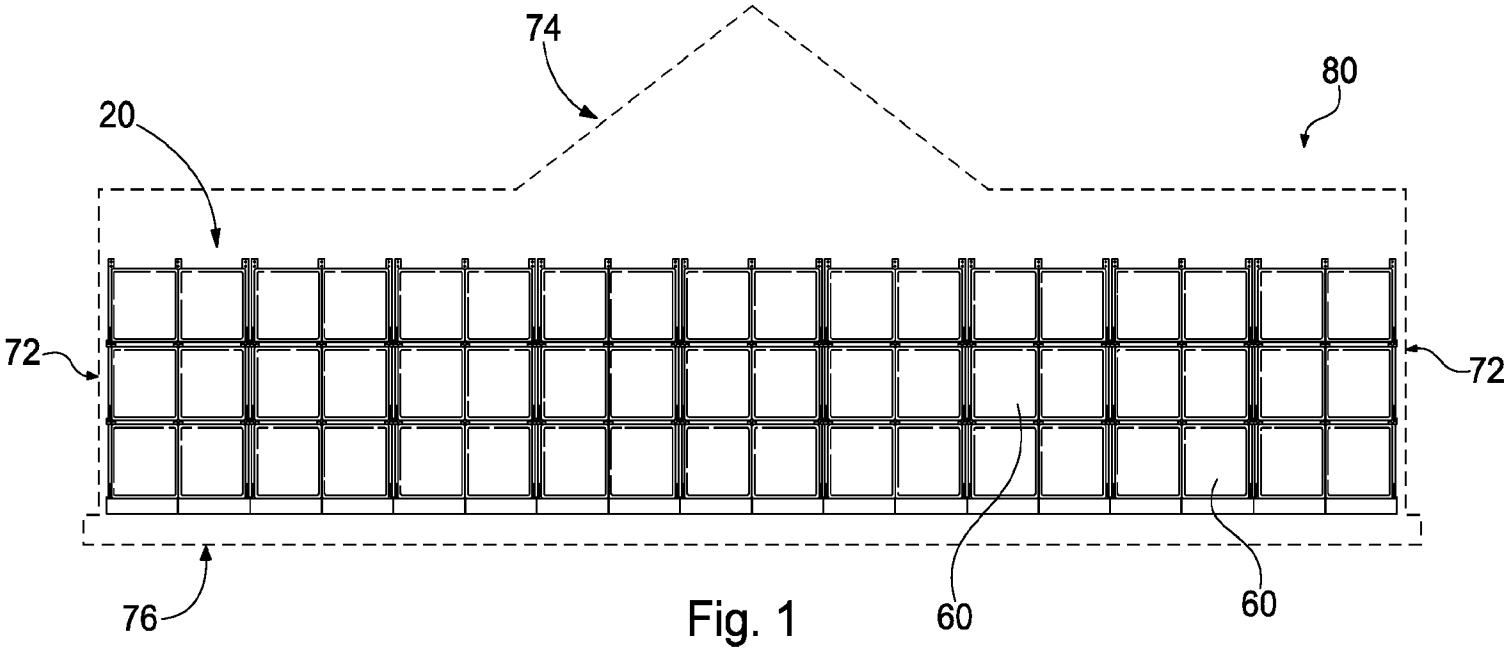
FIG. 1 shows a modular crypt structure with schematically represented walls, roof, and base.
Figure 2:
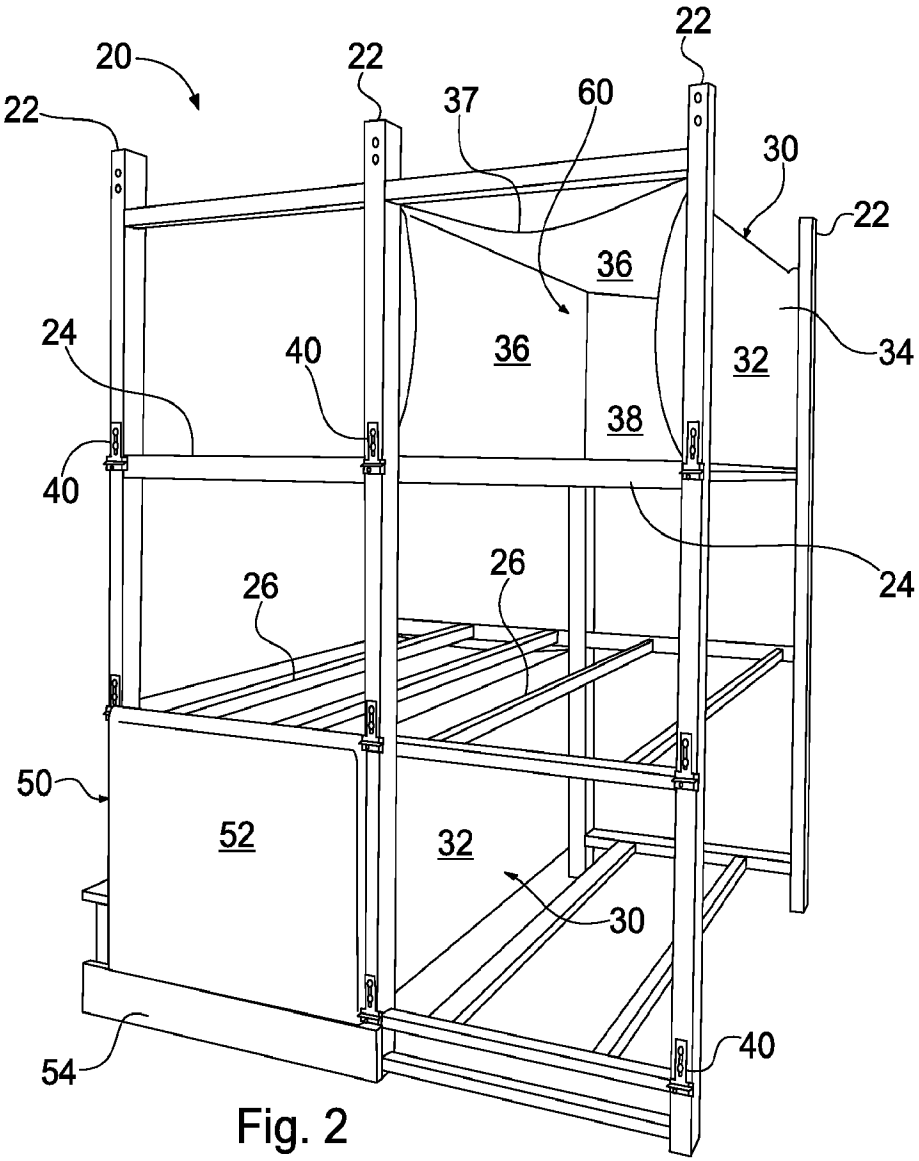
FIG. 2 shows a modular crypt structure frame with a module insert therein and attached closure panel.
Figure 5:
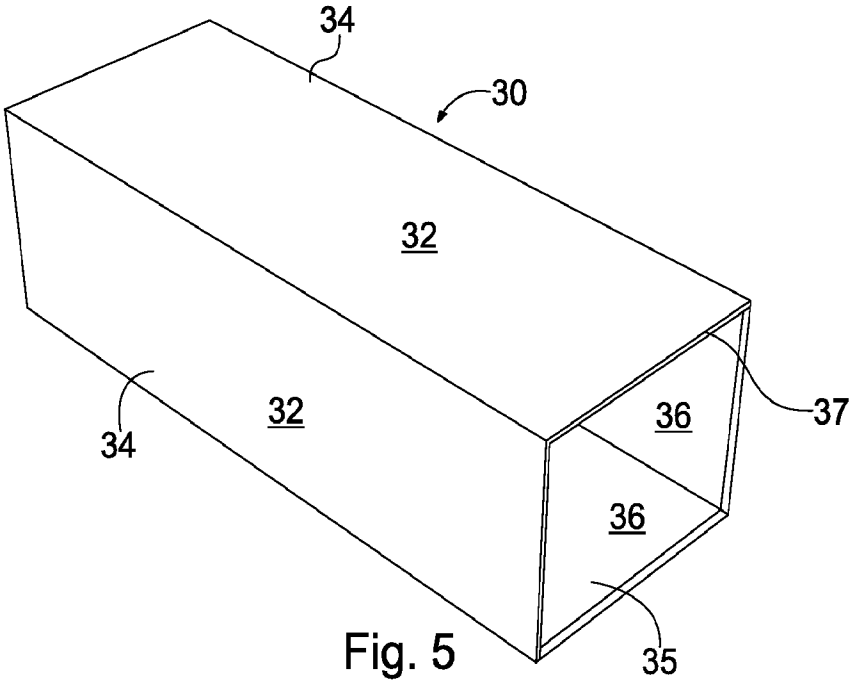
FIG. 5 shows a module insert construction.

FIG. 1 shows an embodiment of the present invention, wherein a modular crypt structure 80 comprises a frame 20, which defines spaces, or alternatively crypt modules 60, for insertion of bodily remains. Frame 20 sits atop a base 76, and is covered by a roof 74, which is supported by walls 72. A crypt module 60 is formed by placing a module insert 30 within frame 20, as indicated in FIG. 2. Module insert 30, which is shown in FIG. 5, includes walls 34 with outside surfaces 32 and inside surfaces 36. Walls 34 define a chamber 35 having a chamber opening 37 at an end of module insert 30. Generally, an end of module insert 30 opposite chamber opening 37 is sealed, as represented by rear wall surface 38 in FIG. 2. Chamber 35 functions as crypt module 60 for insertion of bodily remains or portions of bodily remains when module insert 30 is placed within frame 20. Crypt module 60 may also be closed by attaching a closure panel 50 having front face 52, such as a stone crypt front, to an end of frame 20 adjacent to chamber opening 37 of module insert 30, thereby encapsulating the bodily remains.

Figure 3:
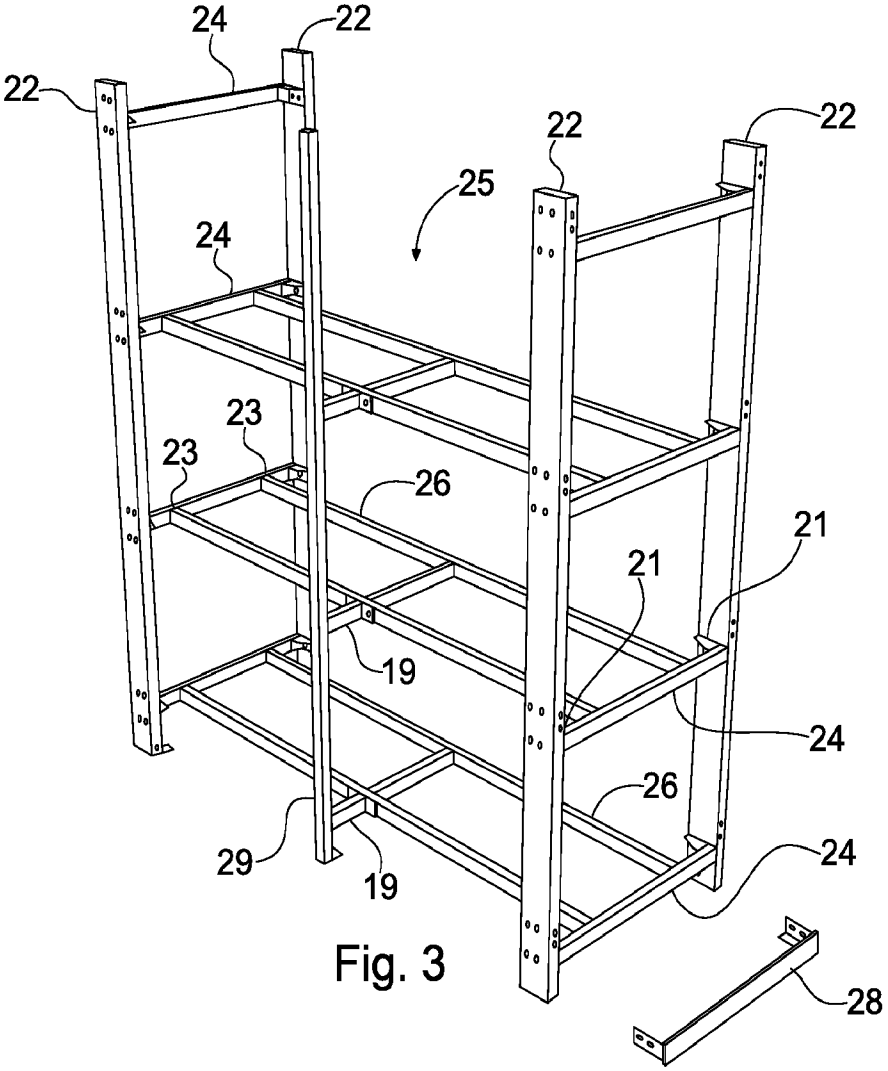
FIG. 3 shows a perspective view of a frame assembly.
Figure 4:
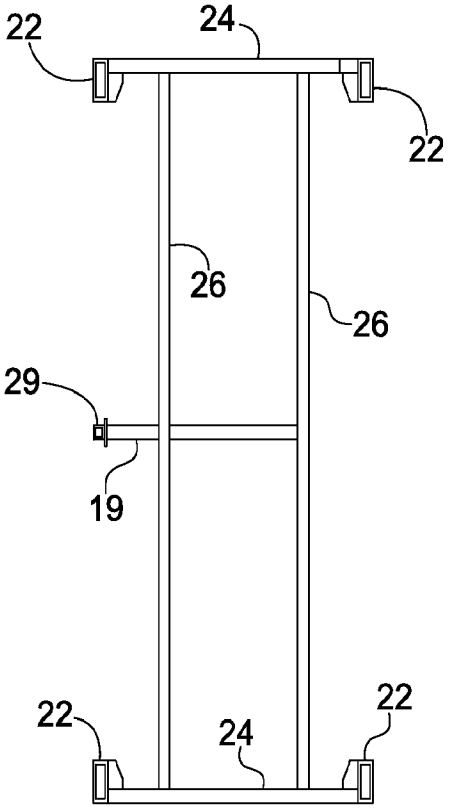
FIG. 4 shows a bottom view of a platform formed by a frame assembly.

As shown in FIG. 3, frame 20 comprises a plurality of vertical bars 22 horizontally aligned and a plurality of horizontal cross bars 24 vertically aligned. Additionally, frame 20 may comprise a plurality of support beams 26 which are vertically aligned. Cross bars 24 are perpendicularly oriented to and intersect vertical bars 22 in a vertical plane. As shown in FIGS. 3-4, when cross bars 24 and support beams 26 intersect and are perpendicularly oriented in a horizontal plane, cross bars 24 and support beams 26 form a platform 25 for supporting module insert 30. Cross bars 24 may be attached to vertical bars 22 via nuts and bolts at joints 21, and cross bars 24 and support beams 26 may be welded at joints 23. Alternatively, horizontal cross bars 24, vertical bars 22 and support beams 26 may be integrally formed. However, any means of attachment sufficient to support module insert 30 are contemplated. Moreover, frame 20 may comprise any material or combination of materials sufficient to support the weight of bodily remains, and preferably comprises a metal, such as steel or aluminum. The vertical bars 22 may, for example, comprise 2 inch by 5 inch tube aluminum and horizontal cross bars 24 and support beams 26 comprise 1.5 inch by 2 inch tube aluminum.

As noted above and as shown in FIG. 5, module insert 30 comprises walls 34 having outside surfaces 32 and inside surfaces 36, wherein walls 34 form a chamber 35 having chamber opening 37. Module insert 30 is then placed within frame 20 on top of and supported by platform 25, as shown in FIG. 2. In this configuration, chamber 35 of module insert 30, functioning as a crypt module 60, may receive bodily remains. Typically, the bodily remains take the form of a corpse encapsulated within a casket and/or coffin; however, crypt module 60 may receive other forms of bodily remains, such as cremated remains. Frame 20 may comprise a plurality of platforms 25, as indicated in the embodiments represented by FIGS. 2-3. As such, a plurality of module inserts 30 may be placed within frame 20. Module insert 30 may comprise any material sufficient to receive and retain bodily remains, such as a plastic material, a polymer material, fiberglass or a metal, for example aluminum.

Figure 9:
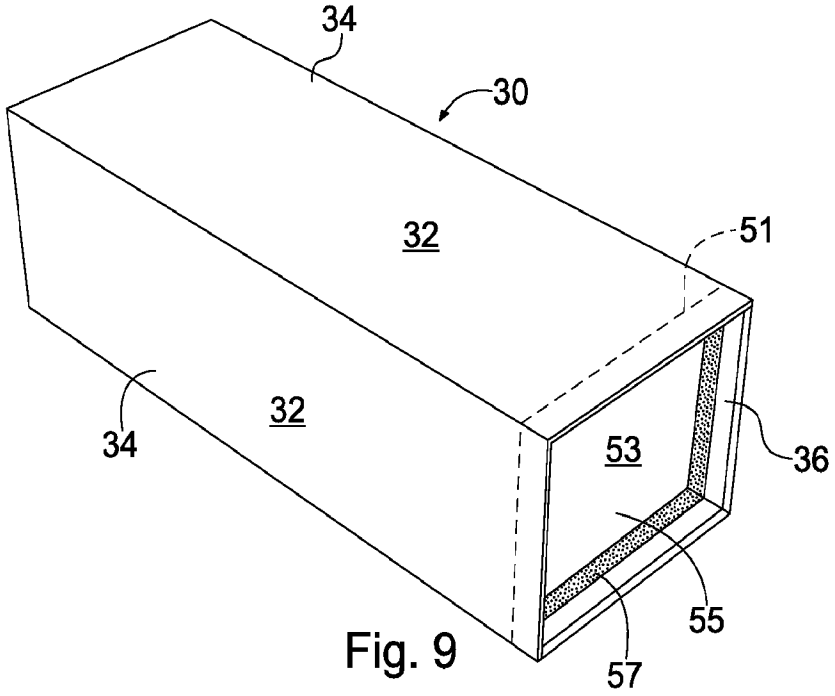
FIG. 9 shows a module insert in conjunction with a crypt sealing cap.

When module insert 30 or a plurality of module inserts 30 have been placed within frame 20, crypt module 60 or a plurality of crypt modules 60 may be sealed by attaching a closure panel 50 or a plurality thereof to an end of frame 20 adjacent chamber opening 37, as shown in FIG. 2. As illustrated, front face 52 of closure panel 50 may be larger than the chamber opening 37 of module insert 30, thereby allowing closure panel 50 to completely conceal chamber opening 37. The closure panel 50 biases and is attached to a front side of frame 20. A crypt module 60 may also comprise a crypt sealing cap 55, as shown in FIG. 9. A crypt sealing cap 55 closes chamber 35 at chamber opening 37, thereby encapsulating the bodily remains prior to attaching closure panel 50 to frame 20. A crypt sealing cap 55 may comprise a fluid-tight material for preventing leakage of fluid into and/or out of crypt module 60. In the embodiment shown in FIG. 9, the crypt sealing cap 55 comprises a U-shaped cap, having a concave surface 53, wherein external surfaces of lips 57 of concave surface 53 of sealing cap 55 contact inside surfaces 36 of module insert 30, thereby fluidly sealing crypt module 60. Line 51 indicates the depth of crypt sealing cap 55 within chamber 35.

Figure 7:
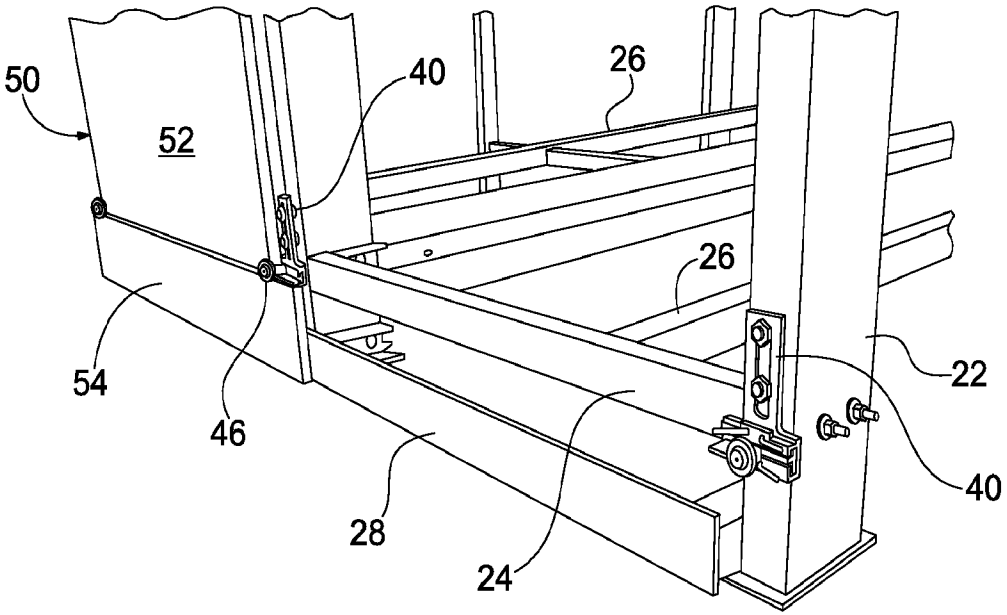
FIG. 7 shows a perspective view of a closure panel which is attached to a frame.

FIGS. 2 and 7 show a closure panel 50 attached to both frame 20 and a trim plate 54, which is attached to frame 20 at a bottom portion thereof. Trim plate 54 may be biased by a base plate 28 shown in FIG. 7. Base plate 28 biases a rear face of trim plate 54, thereby providing a stable backing for trim plate 54. A plurality of base plates 28 may extend around the entire perimeter of frame 20 or a portion thereof for supporting a plurality of trim plates 54 along the sides and front and back ends of frame 20. Closure panel 50 and trim plate 54 may comprise a stone material, such as granite or marble to provide an aesthetically pleasing appearance.

Figure 6:
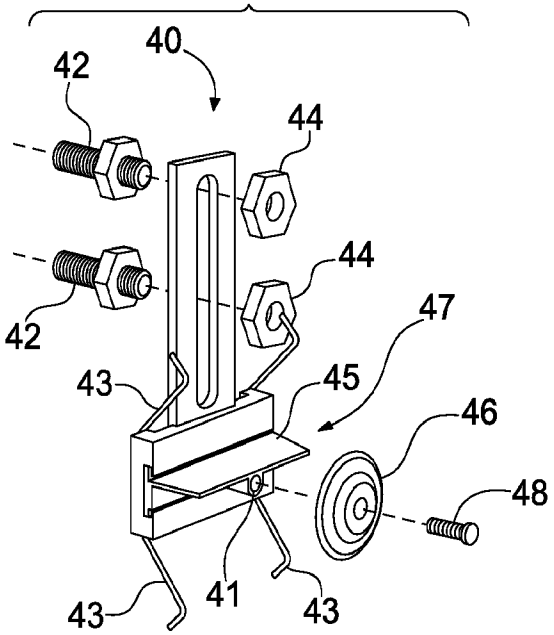
FIG. 6 shows an anchor assembly.

In one embodiment, closure panel 50 and trim plate 54 are secured to frame 20 by an anchor assembly 40. Referring to FIG. 6, the anchor assembly 40 may include nuts 44, bolts 42, spring-loaded flanges 43, rosette 46 and extension 47. In one embodiment, extension 47 is alternatively referred to as a slide, which is removably attached to the body of anchor assembly 40 by sliding thereon. Extension 47 includes top surface 45 and a hole 41. Rosette 46 also may include hole 49. Anchor assembly 40 is secured to frame 20 near joints 21, as shown in FIGS. 2 and 7, by nuts 42 and bolts 44. Referring to FIG. 7, anchor assembly 40 may secure closure panel 50 at a periphery of the closure panel 50 near its corners. Closure panel 50 rests on, and is thereby supported by, top surface 45 of extension 47. Rosette 46 biases a front face 52 of closure panel 50, and is secured by inserting screw 48 through hole 49 of rosette 46 and hole 41 of extension 47. A spring-loaded flange 43 biases a rear surface of closure panel 50 pushing closure panel 50 forward against rosette 46, thereby biasing front face 52 against rosette 46 and securing closure panel 50 in the fore and aft directions. A single anchor assemble 40 may secure up to four closure panels 50, two supported on top surface 45 of extension 47 and two below extension 47, the spring-loaded flanges 43 and rosette 46 biasing corners of a rear surface and the front face 52, respectively, of each closure panel 50. The anchor assembly 40 may comprise an aesthetically pleasing material, such as bronze and/or stainless steel, for example.

Figure 8:
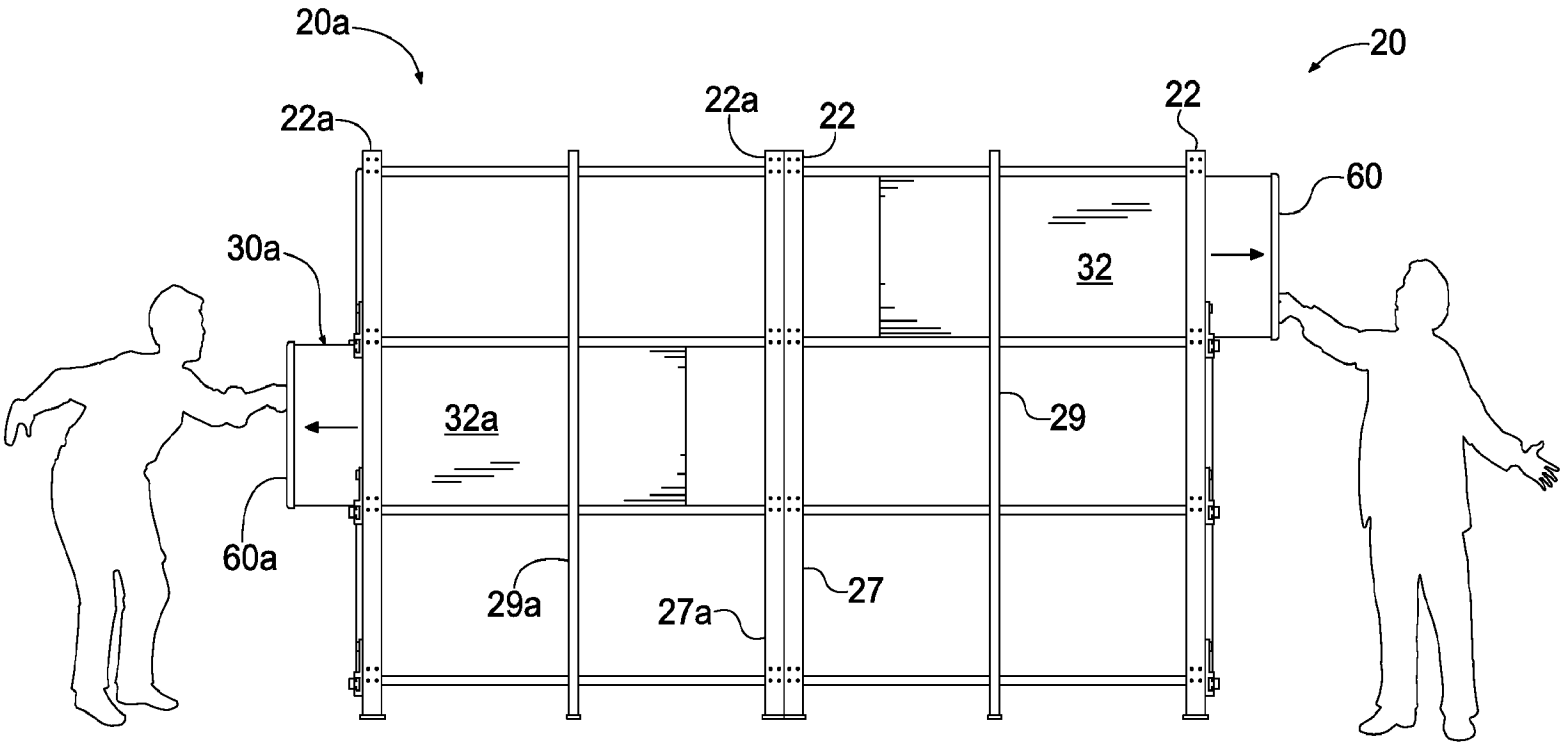
FIG. 8 shows two frame assemblies in a back-to-back orientation.
Figure 10:
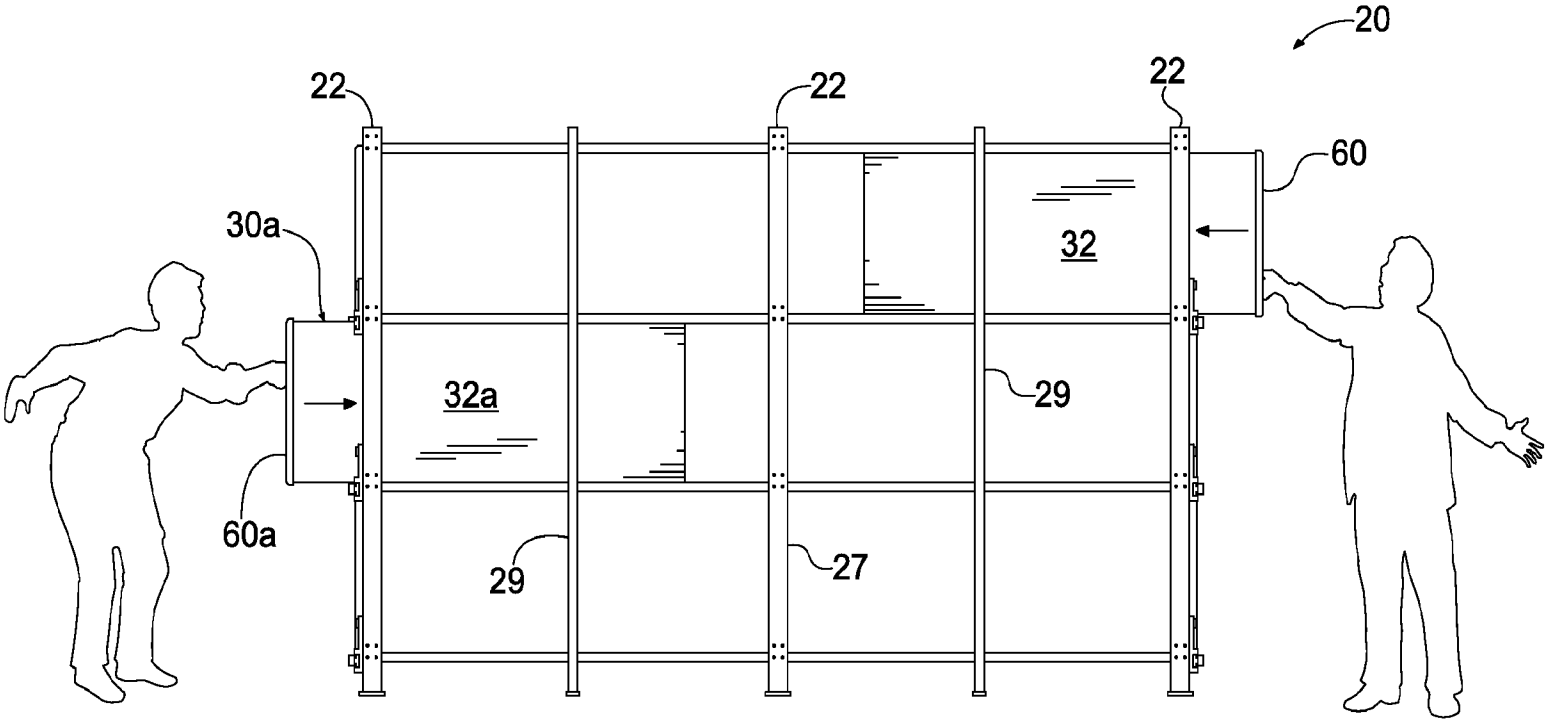
FIG. 10 shows an elongated frame assembly.

Referring to FIG. 8, an alternative embodiment of the described invention comprises a second frame 20*a*. In this embodiment, frames 20 and 20*a* are provided in tandem with back ends 27 and 27*a* oriented adjacent to one another. In this configuration, a modular crypt structure 80 is provided having two opposite ends, wherein module inserts 30 and 30*a* may be placed within frame 20 and second frame 20*a*, respectively, thereby forming two crypt modules 60 and 60*a*, back to back. Closure panels may then be attached to frames 20 and 20*a* to seal respective crypt modules 60 and 60*a*. Alternatively, two crypt modules 60 and 60*a* may be provided back to back in a single integrally formed elongated frame 20, such as that shown in FIG. 10. Additionally, module insert 30 or 30*a* may be formed such that it comprises two opened ends and extends through both frames 20 and 20*a*, supported by platforms 25 and 25*a*, respectively, as shown in FIG. 8, or through elongated frame 20, as shown in FIG. 10, thereby providing a crypt module 60 for the insertion of bodily remains of at least two persons.

Figure 11:
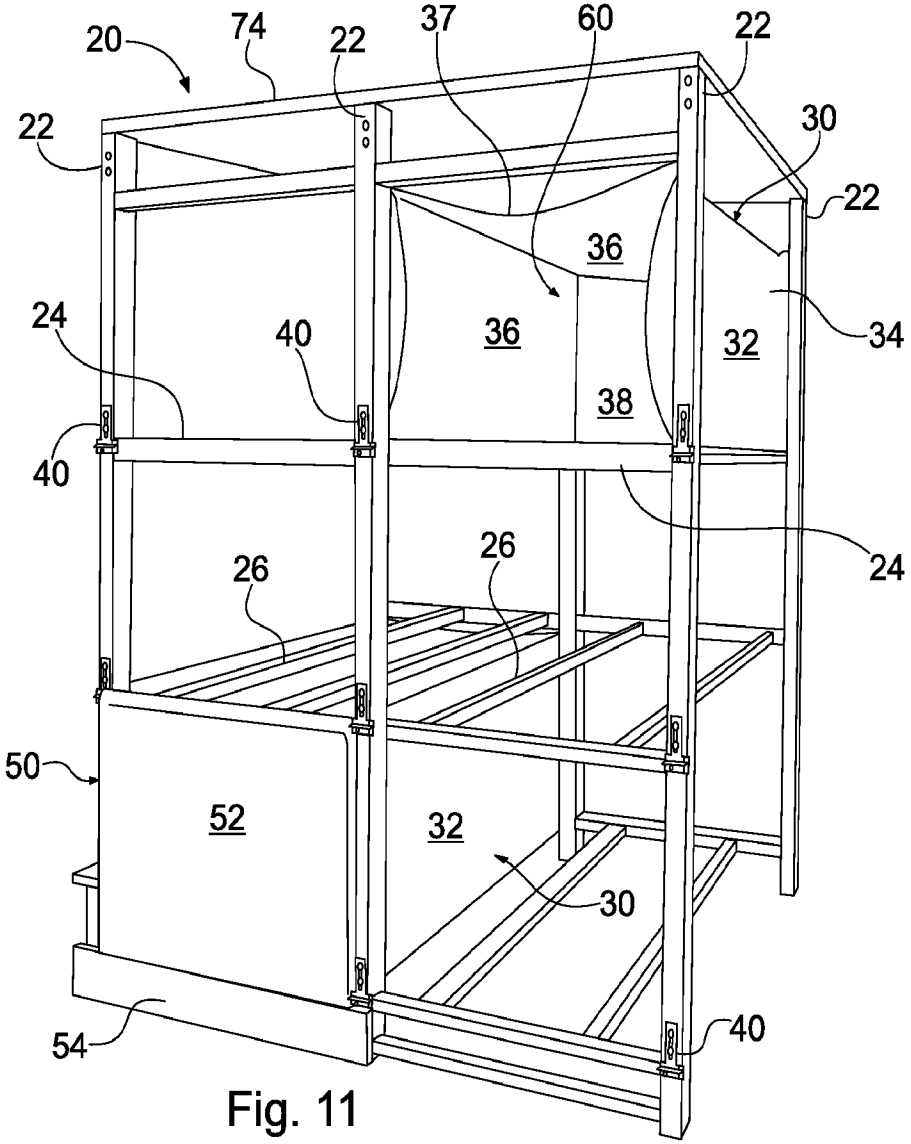
FIG. 11 shows a frame assembly with a roof connected directly to the frame.

A finished modular crypt structure 80 may comprise walls 72, a base 76 and a roof, 74 as shown in FIG. 1, respectively. The walls 72, base 76, and roof 74 may comprise aesthetically pleasing materials, such as granite, marble, brick, or stucco; however, any other materials sufficient for the user's needs are contemplated. Additionally, in a finished crypt structure 80, crypt modules 60 will include a closure panel 50. As such, frame 20 will not be visible, as it is shown in FIG. 1. The walls 72 may run parallel to the sides of frame 20 and in some instances will run behind the rear of frame 20, thereby surrounding frame 20. Roof 74 may then be positioned above frame 20. When a wall 72 is erected and directly attached to a side of frame 20, frame 20 may include a wall support bar 29 or a plurality of wall support bars 29, as shown in FIG. 3. Wall support bar 29, which is attached to frame 20, provides additional stability to wall 72 by biasing an inside face of wall 72. In such constructions, the walls may take the form of multiple plates or a continuous slab of material. Wall support bar 29, as shown, is in a vertical position; however wall support bar 29 may be positioned in other manners, for example, horizontally. As indicated in FIG. 3, wall support bar 29 may be attached to frame 20 via flanges 19. When support bar 29 is positioned in a horizontal manner it may be directly connected to vertical bars 22. Both wall support bar 29 and flanges 19 may comprise 1.5 inch by 2 inch aluminum tube. Alternatively, a finished modular crypt structure 80 may be constructed and housed within an existing or concurrently constructed structure. For example, a frame 20, with accompanying module insert 30 and closure panel 50, may be directly inserted into a block wall structure comprising for example, concrete. A modular crypt structure 80 may be also attached as an extension to a preexisting structure. Referring to FIG. 11, the roof 74 may be secured directed to the frame 20, wherein roof 74 rests directly upon and is supported by vertical bars 22.

On-site, at a place of installation, frame 20 may comprise a plurality of frames 20 in tandem, as discussed above and shown in FIG. 8, side-by-side, as shown in FIG. 1, or in any combination of arrangements. These arrangements may also comprise a single integrally formed frame 20, for example, in FIG. 1, frame 20 may be a single, elongated frame, rather than a plurality of frames, side-by-side. The frame 20 may arrive on-site as a set of separate components, for example, as pluralities of vertical bars 22, horizontal cross bars 24, and support beams 26, to be assembled at the place of installation. Alternatively, the frame 20 may arrive on-site pre-constructed, ready for installation into a pre-existing structure or for erection of new walls around the frame 20. Upon arrival on-site, a frame 20, may be grouped in any desirable arrangement and secured to pre-existing frames. For example, in FIG. 8, frame 20 may arrive on-site, subsequently to frame 20*a*, which would have been previously constructed. Frame 20 may then be arranged and secured in tandem with frame 20*a*.

In yet another embodiment, a modular crypt system 180, as illustrated in FIGS. 12-16, and like the embodiments discussed above, may include a frame 120 having vertical bars 122 and horizontal cross bars 124 with module inserts 130 positioned within frame 120 to define crypt modules 160. Crypt module 160 may also be closed by attaching a closure panel 150 having front face 152, such as a stone crypt front, to an end of frame 120 adjacent to chamber opening 137 of module insert 130, thereby, encapsulating the bodily remains. The modular crypt system 180, however, also includes at least one niche side wall 200 positioned parallel with a side of crypt module frame 120. The niche side wall 200 includes a frame 220, with a niche insert 230 defining a plurality of niches 235 for receiving, for example, cremated bodily remains and/or an accompanying urn.

Figure 15:
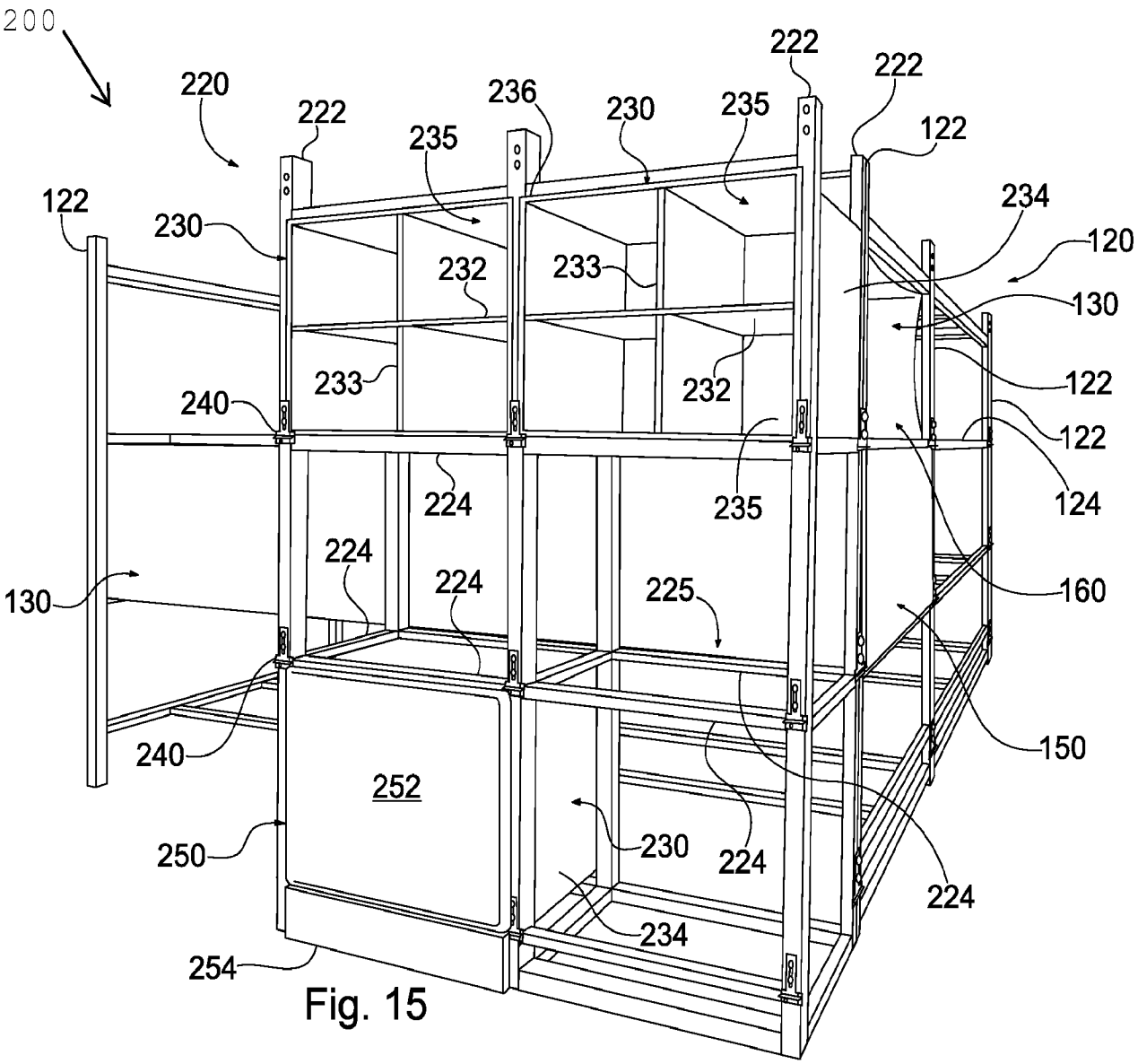
FIG. 15 shows a perspective view of a modular crypt system having a niche side wall attached to a side of a modular crypt frame assembly.
Figure 16:
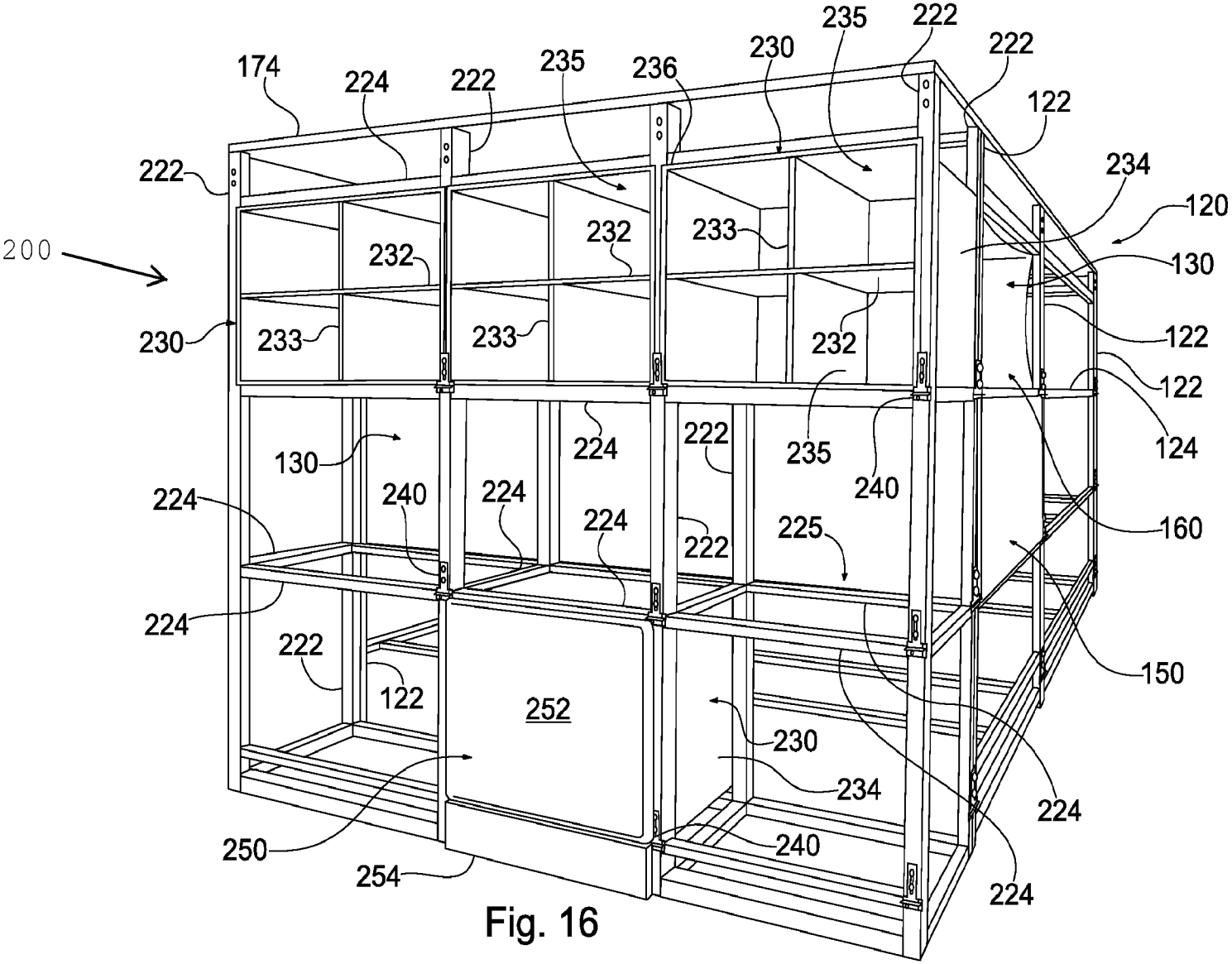
FIG. 16 shows a perspective view of a modular crypt system having a niche side wall attached to a side of a modular crypt frame assembly with a roof.

The niche side wall frame 220, as best illustrated in FIGS. 15 and 16, is positioned along the side of and attached to modular crypt frame 120. As shown in FIGS. 15 and 16, niche side wall frame 220 may extend the entire length of the side of crypt frame 120, or it may extend only partially along the length of the side of crypt frame 120. In the case where niche side wall 200 does not extend the entire length of the side of modular crypt frame 120, as illustrated in FIG. 15, the portion of the crypt frame 120 side that does not include niche side wall 200 will generally comprise a wall, such as wall 72, illustrated in FIG. 1.

Figure 14:
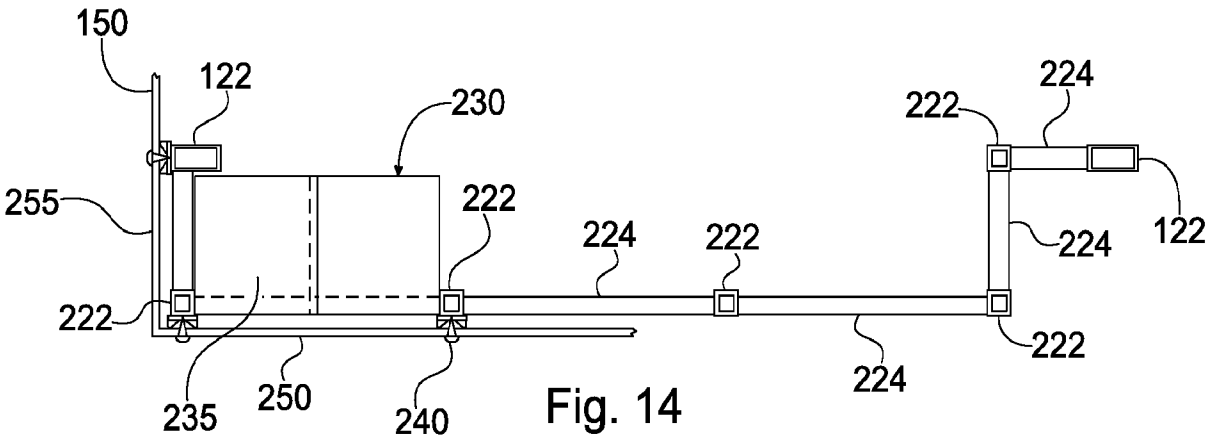
FIG. 14 shows a top cross-sectional view of a niche side wall assembly.

Niche side wall frame 220 includes a plurality of vertical bars 222 horizontally aligned and a plurality of horizontal cross bars 224 vertically aligned. Referring to FIGS. 15 and 16, the vertical bars 222 located at the rear portion of niche side wall 200 may be positioned against vertical bars 122 of crypt module frame 220. These adjacent vertical bars 122, 222 may be secured together, such as by nuts and bolts, by welding, rivets, or any other means sufficient to secure niche side wall frame 220 to modular crypt frame 120. Alternatively, the top view of niche side wall frame 220 in FIG. 14 shows vertical bars 222 connected to preexisting vertical bars 122 of modular crypt frame 120 via horizontal cross bars 224, as opposed to vertical bars 122, 222 being positioned against each other. This will generally be the case, i.e., bars 224 being connected to vertical bar 122, such that niche side wall frame 220 and modular crypt frame 120 share a vertical bar, when the modular crypt system 180, including the niche side wall 200 are installed as a single new construction, as opposed to retrofitting a preexisting modular crypt with a niche side wall 200, wherein vertical bars 122, 222 may be positioned against each other. As shown, a single vertical bar 222 on the back portion of niche side wall frame 220 may be necessary where the niche side wall 200 does not extend the entire length of the side of module crypt frame 120 in order to secure niche side wall frame 220 to vertical bars 122 of modular crypt frame 120. As illustrated, the single vertical bar 222 on the back portion of niche side wall frame 220, in conjunction with the preexisting vertical bar 122 of modular crypt frame 120 and horizontal cross bars 224, form a corner recess at the portion of the side of modular crypt frame 120 of which niche side wall 200 does not extend across. Niche side wall frame 220 may also be attached to modular crypt frame 120 at other locations, for example where horizontal cross bars 224 of niche side wall frame 220 contact cross bars 122 of modular crypt frame 120.

The cross bars 224 and vertical bars 222 of niche side wall frame 220 intersect and are perpendicularly oriented in a vertical plane. As shown in FIGS. 12 and 14-16, horizontal bars 224 extend across the front of frame 220 between adjacent vertical bars 222, and from the front to back of frame 220 between adjacent vertical bars 222. Where cross bars 224 and vertical bars 222 intersect, cross bars 224 define a support shelf 225 for receiving niche insert 230. Cross bars 224 may be attached to vertical bars 222 via nuts and bolts at joints 221 or may be welded at joints 221. Alternatively, horizontal cross bars 224 may be integrally formed with vertical bars 222. However, any means of attachment sufficient to support niche insert 230 are contemplated. Moreover, frame 220 may comprise any material or combination of materials sufficient to support niche insert 230 and, preferably, comprises a metal, such as steel or aluminum. The bars 222, 224 may, for example, be constructed of tube aluminum.

Figure 13:
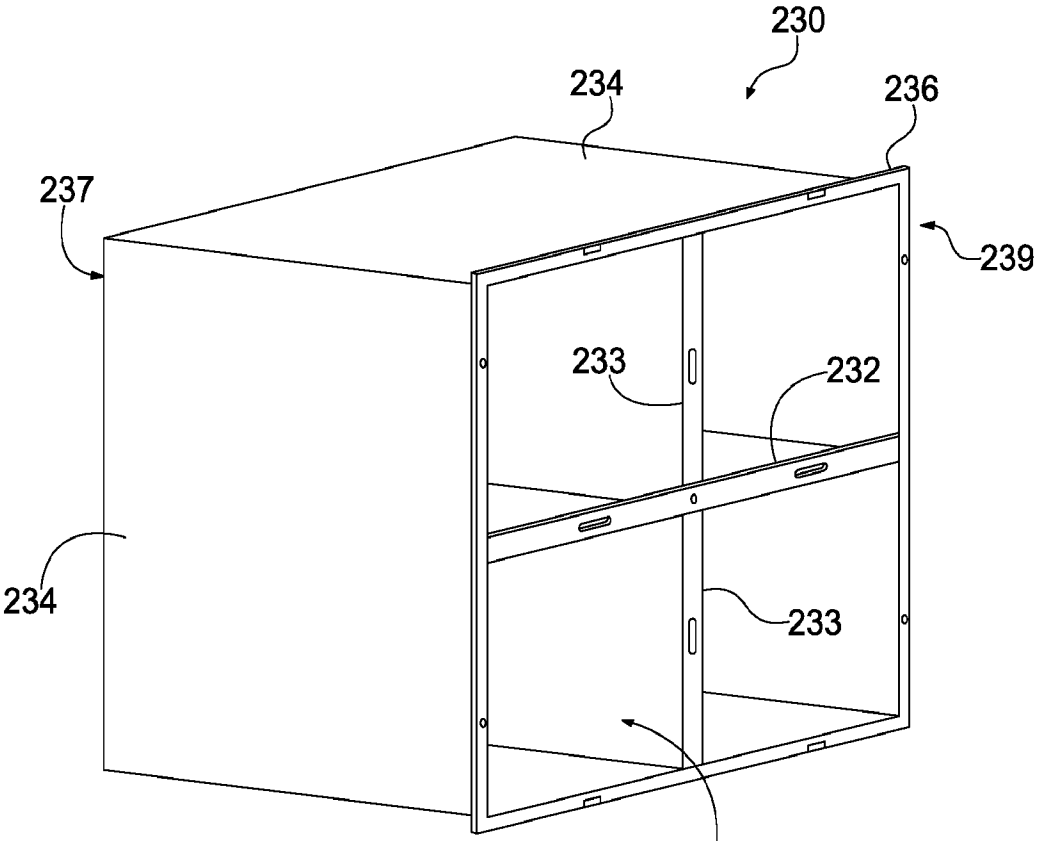
FIG. 13 shows a perspective view of a niche insert for a niche side wall assembly.

As best shown in FIG. 13, the niche insert 230 includes a plurality of side walls 234 and defines a plurality of niches 235 for receiving, for example, cremated bodily remains and/or an accompanying urn. The niche insert 230 includes a closed end 237 and an open end 239. The niches 235 are defined at and accessible from the open end 239 of the niche insert 230. The niches 235 may, for example, be defined in niche insert 230 by the presence of internal, horizontal and vertical walls 232, 233 which are oriented perpendicularly to one another. The horizontal and vertical walls 232, 233 may be integrally formed with side walls 234 or, alternatively, may be separate wall components attached to side walls 234 by, for example, welding or mechanical fastening, such as by nuts and bolts. The open end 239 of niche insert 230 may also include a flange edge 236 positioned about the periphery of the open end 239 for attaching the insert 230 to the bars 222, 224 of niche side wall frame 220. The niche insert 230 may be constructed of the same material as the side wall frame 220. The niched insert 230 may be constructed of a metal, such as Aluminum or steel, for example.

Figure 12:
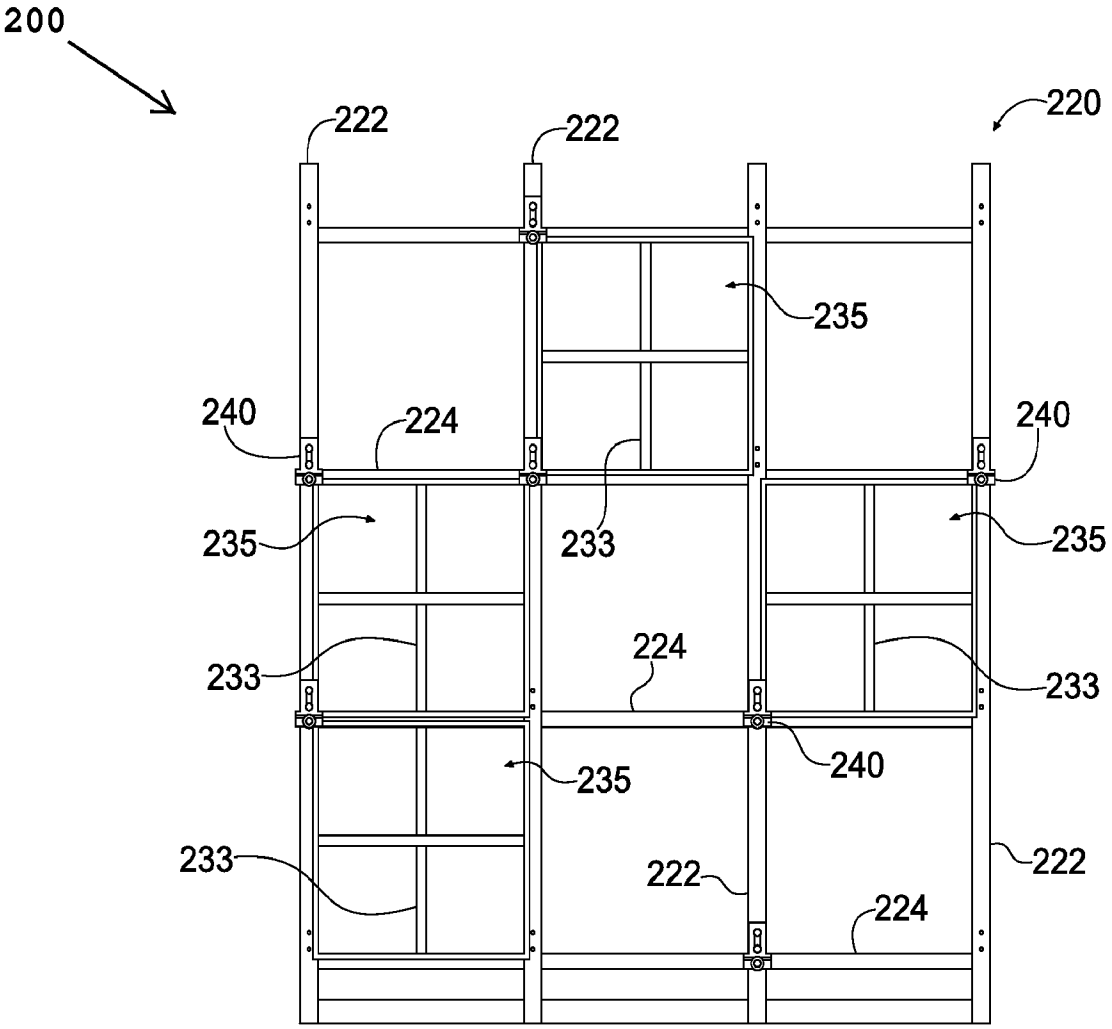
FIG. 12 shows a front plan view of a niche side wall frame.

Referring to FIGS. 12, 15, and 16, the niche insert 230 may be inserted into frame 220 and positioned on support shelf 225 defined by vertical and horizontal bars 222, 224 with the open end 239 facing away from modular crypt frame 120 and closed end 237 facing toward modular crypt frame 120. The flange edge 236 provided around the periphery of niche insert 230 provides a means of securely fastening niche insert 230 to niche side wall frame 220. The flange edge 236 is positioned in abutment with a front face of the vertical and horizontal bars 222, 224, and may be secured to the vertical and horizontal bars, 222, 224 mechanically, for example, by nuts and bolts extending through flange edge 236 and horizontal and vertical walls 232, 233. However, the niche insert 230 may be attached to niche side wall frame 220 by any suitable means to fixedly secure the niche insert 230 to niche side wall frame 220.

When niche insert 230 has been adequately secured to niche side wall frame 220, niches 235 may be closed by attaching a closure panel 250 having a front face 252 to the niche side wall frame 220 adjacent the open end 239 of niches 235. As illustrated, front face 252 of closure panel 50 may be larger or equal in size to the cross-sectional area of niche insert 230, thereby concealing all niches 235 defined in niche insert 230. This may be the case even where all of niches 235 of niche insert 230 do not contain bodily remains, such as cremated remains contained in an urn. The closure panel 250 may provide an aesthetically pleasing appearance by, for example, being constructed of a stone material, such as granite or marble. FIG. 14 shows closure panel 250 attached to niche side wall frame 220 from a top view. Also shown in FIG. 14 is a closure panel 150 attached to modular crypt frame 120 and a wall extension 255 extending across a side and around the corner of niche side wall frame 220. Wall extension 255, like closure panel 250, may be constructed of a stone material, such as granite or marble. When every support shelf 225 of niche side wall frame 220 is provided with a niche insert 230, which is closed by closure panel 250, the closure panels 250, in conjunction with wall extension 255 and closure panels 150 of modular crypt frame 120, provide the appearance of a continuous granite wall around the periphery of module crypt system 180. The closure panel 250 and wall extension 255 may be secured to frame via an anchor assembly 240, which may operate in substantially the same manner as anchor assemble 40 described above with respect to FIG. 6. Additionally, as described with respect to the above discussed embodiments, a trim plate 254, shown in FIGS. 15-17, may be attached to a bottom portion of niche side wall frame 220 below closure panel 250, in the same manner as trim plate 54 shown in FIG. 7. Trim plate 254, like closure panel 250, may be constructed of a stone material, such as granite or marble. At the corners of frames 120, 220, the modular crypt system 180 may include a side trim which is supported by a trim angle connected to vertical bar 222 or 122 located at the ends of the frames 120, 220. The side trim outlines the corners of modular crypt system 180 and may close any gaps between the closure panels or wall extensions.

Figure 17:
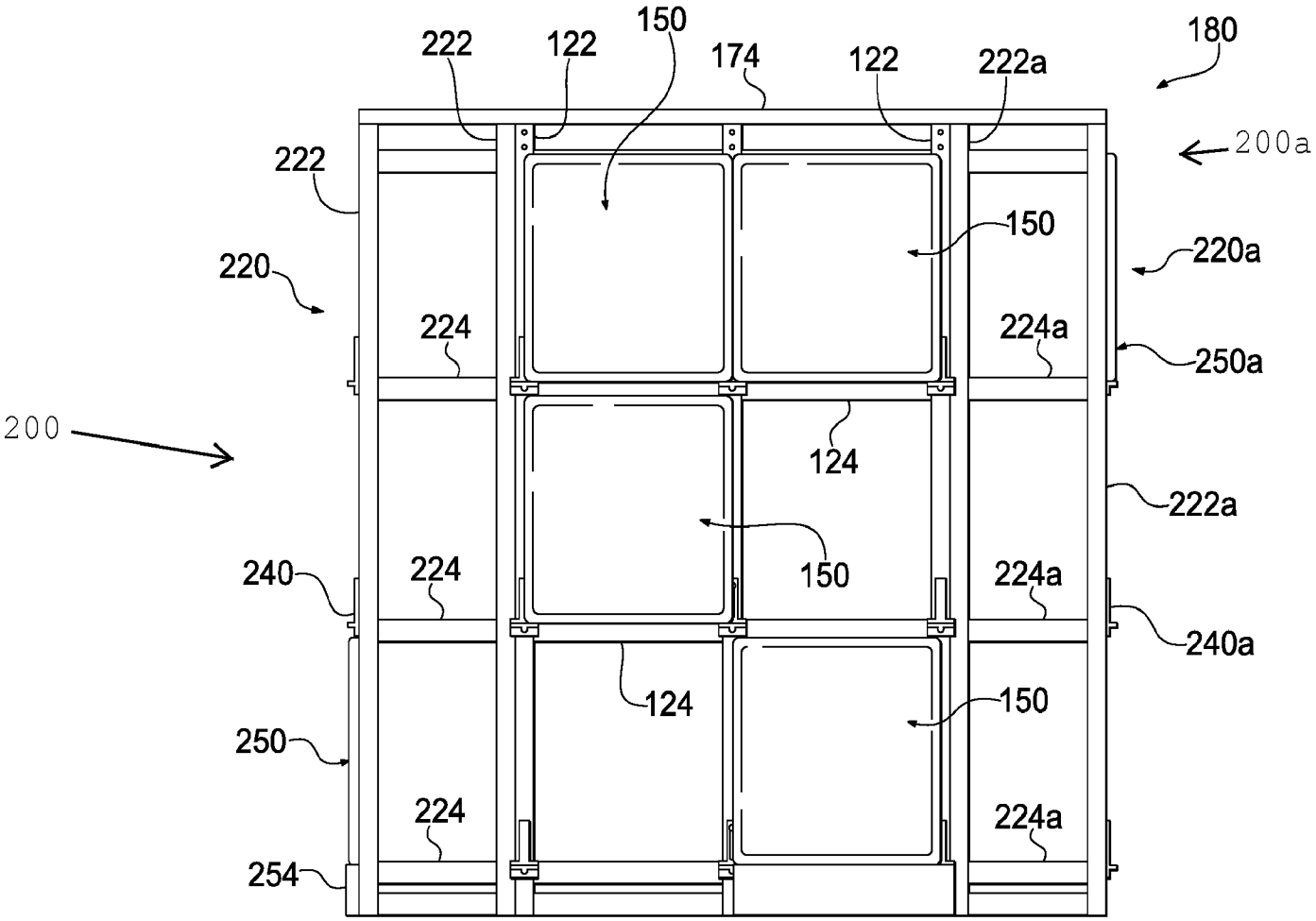
FIG. 17 shows a front plan view of a modular crypt system having two niche side walls attached.

Referring to FIG. 16, the modular crypt system 180 may include a roof 174 extending across the top of both frames 120, 220 and supported by the vertical bars 122, 222. The roof may be directly secured to vertical bars 122, 222. Referring to FIG. 17, the crypt structure may include two niche side walls 200, **200*a* positioned on and attached to each side of modular crypt frame 120. The roof 174 may extend across each of the modular crypt frame 120, and the niche side wall frames 220, 220*a* of niche side walls 200, 200*a*. Alternatively, if a roof 174 takes the form of roof 74, as illustrated in FIG. 1, the roof 174 may be supported by niche side walls 200, 200*a* only. If the niche side walls 200, 200*a* extend the entire length of the sides of modular crypt frame 120, such as niche wall 200, illustrated in FIG. 16, then no unmemorialized side walls, such as walls 72 in FIG. 1, would be required to construct a complete modular crypt system 180. In this configuration, modular crypt system 180 may take the form of a mausoleum having memorial faces, such as closure panels 150, 250 on at least three of four sides. In the case when modular crypt frame 120 takes the form of an elongated frame having crypt modules 160 on both first and second ends, such as frame 20 of FIG. 10, modular crypt system 180, as shown in FIG. 17, would include memorial faces on all four sides. No unmemorialized side walls would be required to construct modular crypt system 180**, thereby, providing for an inexpensive and aesthetically pleasing mausoleum that maximizes use of its space.

In any of the above-discussed embodiments, time and man-power are significantly reduced in comparison to that required to build a typical crypt structure. There is no longer a need to pour excessive amounts of concrete using wood forms to construct the entire crypt structure, including each crypt module. The time to construct a modular crypt structure 80 or a modular crypt system 180 on-site, according to the present invention, is estimated to be approximately one-third of the time required to construct and cure a typical concrete crypt structure. Additionally, with frames 20, 120, 220 comprising a lightweight material, such as aluminum for example, manufacturing and transportation expenses are reduced.

As noted above, while specific embodiments of the invention have been described, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

The invention claimed is:

1. A modular crypt structure comprising:

a first frame comprising a first side, a second side, and a first end transverse to the first side and the second side;

one or more module inserts positioned within the first frame, each module insert comprising a plurality of walls defining a chamber having at least one open end, wherein the chamber is adapted to receive non-cremated, full body remains;

a closure panel, the closure panel being attached to the first end of the first frame adjacent to the at least one open end of said chamber; and one or more niche inserts positioned within the first frame, each niche insert defining a niche insert open end and a plurality of niches adapted to receive cremated remains.

2. The modular crypt structure according to claim 1, wherein the one or more module inserts comprise one open end and one closed end.

3. The modular crypt structure according to claim 1, wherein the first frame comprises a plurality of horizontal bars vertically aligned with one another, a plurality of vertical bars horizontally aligned with one another, and a plurality of support beams, wherein the horizontal bars intersect the vertical bars, and the support beams intersect the horizontal bars in a horizontal plane, such that a platform is formed, the one or more module inserts being positioned on the platform.

4. The modular crypt structure according to claim 1, further comprising a trim plate attached to a bottom portion of the frame.

5. The modular crypt structure according to claim 1, further comprising a crypt sealing cap attached to the one or more module inserts at an end adjacent to the at least one end of said chamber.

6. The modular crypt structure according to claim 1, wherein the frame comprises aluminum.

7. The modular crypt structure according to claim 1, wherein the one or more module inserts comprise a material selected from the group consisting of fiberglass, plastic, polymer material and metal.

8. The modular crypt structure according to claim 1, wherein the closure panel comprises marble or granite.

9. The modular crypt structure according to claim 1, further comprising an anchor assembly for attaching the closure panel to the frame, the anchor assembly securing a periphery of the closure panel to the frame.

10. The modular crypt structure according to claim 9, wherein the anchor assembly comprises an anchor assembly body, a spring-loaded flange, an extension attached to the anchor assembly body and defining a hole therein, at least one bolt, a rosette defining a hole therein, and a screw, wherein the bolt secures the anchor assembly body to the frame, the screw extending through the rosette hole and the extension hole, the screw securing the rosette to the extension, the closure panel resting on a top surface of the extension and the spring-loaded flange biasing a rear surface of the closure panel such that a front surface of the closure panel is biased against the rosette.

11. The modular crypt structure according to claim 1, further comprising a second frame, wherein a back end of the second frame is positioned adjacent to a back end of the first frame.

12. The modular crypt structure according to claim 11, comprising at least two module inserts each comprising a plurality of walls defining a chamber having at least one open end, wherein a first insert is positioned within the first frame, the at least one open end of the first insert located at an end opposite the back end of the first frame, wherein a second insert is positioned within the second frame, the at least one open end of the second insert located at an end opposite the back end of the second frame, the chambers adapted to receive bodily remains or portions thereof.

13. The modular crypt structure according to claim 11, further comprising a second closure panel, the second closure panel being attached to the second frame at an end opposite the back end of the second frame.

14. The modular crypt structure according to claim 1, further comprising a roof and at least two walls, wherein the first frame comprises a first side and a second side, a first wall positioned parallel to the first side, a second wall positioned parallel to the second side, and the roof being positioned above the frame and being supported by the first and second walls, such that the first frame is surrounded by the roof and first and second walls.

15. The modular crypt structure according to claim 14, wherein the frame comprises a plurality of wall support bars positioned on the first and second sides of the frame, the wall support bars biasing an inside surface of the first and second walls.

16. The modular crypt structure according to claim 1, further comprising a roof, wherein the frame comprises a plurality of vertical bars horizontally aligned, wherein the roof extends across a width and a length of the frame and is supported by and directly secured to the vertical bars.

17. The modular crypt structure of claim 1, wherein each of the one or more niche inserts is positioned within at least one of the first side and the second side of the first frame.

18. The modular crypt structure of claim 1, further comprising a niche closure panel attached to at least one of the first side and the second side of the first frame, adjacent the niche insert open end of at least one of the one or more niche inserts, to enclose the plurality of niches.

19. A method for constructing a modular crypt comprising the steps of:

erecting a frame;

providing one or more module inserts to be supported by the frame, wherein each module insert defines a chamber having at least one open end adapted to receive non-cremated, full body remains;

providing one or more niche inserts to be supported by the frame, wherein each of the one or more niche inserts defines a niche insert open end and a plurality of niches adapted to receive cremated remains;

positioning each module insert and each niche insert within the frame; and closing the at least one open end of each chamber and the niche insert open end of each niche insert.

20. The method of constructing a modular crypt of claim 19, wherein closing the at least one open end of each chamber comprises attaching a closure panel to the frame at an end of the frame associated with the at least one open end of the chamber.

21. The method of constructing a modular crypt of claim 19, wherein erecting a frame comprises:

providing a plurality of vertical bars;

providing a plurality of horizontal bars;

providing a plurality of support beams;

aligning the vertical bars horizontally and the horizontal bars vertically such that the vertical bars and horizontal bars intersect; and forming a platform by arranging the support beams such that they intersect the vertical bars in a horizontal plane;

wherein, positioning the one or more module inserts in the frame comprises positioning the one or more module inserts on the platform.

22. The method of constructing a modular crypt of claim 19, further comprising:

providing a plurality of walls and a roof;

erecting the walls around sides of the frame; and positioning the roof above the frame.

23. A method of encapsulating bodily remains comprising:

erecting a frame;

providing one or more module inserts, wherein each module insert defines a chamber adapted to receive non-cremated, full body remains;

providing one or more niche inserts, wherein each niche insert defines a plurality of niches adapted to receive cremated remains;

positioning each module insert and each niche insert within the frame;

inserting bodily remains or portions thereof into one or more of the chamber of at least one of the one or more modules inserts and the plurality of niches of at least one of the one or more niche inserts; and closing an open end of each chamber and a niche open end of each niche insert.

24. The method of encapsulating bodily remains of claim 23, wherein closing an open end of each chamber comprises attaching a closure panel to the frame at an end of the frame associated with the at least one open end of the chamber.

25. The method of encapsulating bodily remains of claim 24, wherein closing an open end of each chamber further comprises providing a sealing cap in the chamber near the at least one open end of the chamber.

26. The method of encapsulating bodily remains of claim 23, wherein erecting a frame comprises:

providing a plurality of vertical bars;

providing a plurality of horizontal bars;

providing a plurality of support beams;

aligning the vertical bars horizontally and the horizontal bars vertically such that the vertical bars and horizontal bars intersect; and forming a platform by arranging the support beams such that they intersect the vertical bars in a horizontal plane;

wherein the step of positioning the module insert in the frame comprises positioning the one or more module inserts on the platform.

27. A modular crypt system comprising:

a crypt frame having a first side and a second side;

one or more module inserts, each module insert comprising a plurality of walls defining a chamber having at least one open end, wherein each module insert is positioned within the crypt frame and the chamber is adapted to receive non-cremated, full body remains;

a closure panel, the closure panel being attached to the crypt frame at an end of the crypt frame adjacent to the at least one open end of said chamber;

a first niche side wall positioned parallel to at least one of the first side and the second side of the crypt frame comprising:

a side wall frame fixed to at least one of the first side and second side of the crypt frame;

a niche insert having a closed end and an open end and positioned in the side wall frame such that the closed end faces toward the crypt frame and the open end faces away from the crypt frame, the niche insert defining a plurality of niches accessible from the open end of the niche insert and adapted to receive cremated remains; and a niche closure panel attached to the side wall frame adjacent the open end of the niche insert closing the plurality of niches.

28. The modular crypt system of claim 27, wherein the niche insert further comprises a plurality of internal niche walls defining the plurality of niches.

29. The modular crypt system of claim 28, wherein the internal niche walls comprise intersecting vertical and horizontal walls.

30. The modular crypt system of claim 27, wherein the side wall frame comprises a plurality of horizontal bars vertically aligned with one another and a plurality of vertical bars horizontally aligned with one another, wherein the horizontal bars intersect the vertical bars.

31. The modular crypt system of claim 30, wherein the niche insert comprises a flange edge positioned around the periphery of the open end of niche insert, wherein flange edge engages a front surface of the horizontal and vertical bars.

32. The modular crypt system of claim 31, comprising a plurality of niche closure panels, each niche closure panel attached to the side wall frame adjacent the open end of a niche insert of the plurality of niche inserts closing the plurality of niches of each niche insert.

33. The modular crypt system of claim 27, comprising a plurality of niche inserts, each niche insert having a closed end and an open end positioned in the second frame such that the closed ends face toward the crypt frame and the open end faces away from the crypt frame, the niche inserts each defining a plurality of niches accessible from the open end of the niche insert and adapted to receiving bodily remains.

34. The modular crypt system of claim 27, further comprising a second niche side wall, the first niche side wall positioned parallel to the crypt frame first side and the second niche side wall positioned parallel to the crypt frame second side, the second niche side wall comprising:

a second side wall frame positioned parallel to and attached to the second side of the crypt frame;

a second niche insert having a closed end and an open end and positioned in the second side wall frame such that the closed end faces toward the crypt frame and the open end faces away from the crypt frame, the second niche insert defining a plurality of niches accessible from the open end of the niche insert and adapted to receive bodily remains; and a second niche closure panel attached to the second side wall frame adjacent the open end of the second niche insert closing the plurality of niches.

35. The modular crypt system of claim 34, further comprising a roof being positioned above the crypt frame and being supported by the first and second niche side walls.

36. The modular crypt system of claim 34, further comprising a roof, wherein each of the crypt frame, the first side wall frame, and the second side wall frame comprises a plurality of vertical bars horizontally aligned, wherein the roof extends across each of the crypt frame, the first side wall frame, and the second side wall frame and is supported by and secured to the vertical bars.

37. The modular crypt system of claim 27, further comprising a roof positioned above the crypt frame and being supported by the first niche side wall.

* * * * *